US005114763A

United States Patent [19]

Brant et al.

[11] Patent Number: 5,114,763

[45] Date of Patent: May 19, 1992

[54] TACKIFIED POLYETHYLENE LAYERS IN STRETCH/CLING FILMS

[75] Inventors: Patrick Brant, Seabrook; Paul M. German, Friendswood, both of Tex.

[73] Assignee: Exxon Chemical Patents Inc., Linden, N.J.

[21] Appl. No.: 635,194

[22] Filed: Dec. 28, 1990

[51] Int. Cl.[5] ..... B65B 53/00

[52] U.S. Cl. ..... 428/34.9; 428/500; 428/516; 525/240

[58] Field of Search ..... 428/500, 516, 34.9; 525/240

[56] References Cited

U.S. PATENT DOCUMENTS

| | | | |
|---|---|---|---|
| 3,508,944 | 4/1970 | Henderson et al. | 117/7 |
| 3,748,962 | 7/1973 | Hilkert et al. | 90/4 |
| 3,817,821 | 6/1974 | Gallini | 161/165 |
| 4,022,646 | 5/1977 | Casey | 156/164 |
| 4,082,877 | 4/1978 | Shadle | 428/35 |
| 4,147,827 | 4/1979 | Breidt, Jr. et al. | 428/218 |
| 4,189,420 | 2/1980 | Sugimoto et al. | 260/31.6 |
| 4,194,039 | 3/1980 | Mueller | 428/213 |
| 4,303,710 | 12/1981 | Bullard et al. | 428/35 |
| 4,327,009 | 4/1982 | Allen et al. | 524/114 |
| 4,337,298 | 6/1982 | Karim et al. | 428/461 |
| 4,364,981 | 12/1982 | Horner et al. | 428/35 |
| 4,367,113 | 1/1983 | Karim et al. | 156/327 |
| 4,367,256 | 1/1983 | Biel | 428/218 |
| 4,399,180 | 8/1983 | Briggs et al. | 428/212 |
| 4,418,114 | 11/1983 | Briggs et al. | 428/218 |
| 4,425,268 | 1/1984 | Cooper | 524/110 |
| 4,436,788 | 3/1984 | Cooper | 428/483 |
| 4,504,434 | 3/1985 | Cooper | 264/22 |
| 4,518,654 | 5/1985 | Eichbauer et al. | 428/331 |
| 4,524,099 | 6/1985 | Di Luccio | 428/213 |
| 4,588,650 | 5/1986 | Mientus et al. | 428/516 |
| 4,833,017 | 5/1989 | Benoit | 428/323 |

FOREIGN PATENT DOCUMENTS

| | | |
|---|---|---|
| 8291930 | 7/1983 | Australia . |
| 0198091 | 7/1985 | European Pat. Off. . |
| 0287272 | 7/1988 | European Pat. Off. . |
| 0317166 | 9/1988 | European Pat. Off. . |
| 2031801 | 7/1969 | France . |
| 2123747 | 10/1982 | United Kingdom . |

*Primary Examiner*—Edith L. Buffalow
*Attorney, Agent, or Firm*—C. L. Bell; Myron B. Kurtzman

[57] ABSTRACT

A thermoplastic film is provided which is especially suited for use in stretch/cling applications such as, for example, the bundling, packaging and unitizing of foods and other goods. The film comprises a cling layer comprising a polyethylene, preferably low density polyethylene (LLDPE) and a compatible tackifier. The LLDPE has a density of from about 0.87 to about 0.92 g/cc, a melt index of from about 1 to about 30 dg/min and a ratio of weight average molecular weight to number average molecular weight ($M_w/M_n$) less than about 6. The blend has a glass transition temperature of about 0° C. or less. The film may be a one-sided cling film having a polyolefin slip layer opposite the cling layer.

23 Claims, 1 Drawing Sheet

TACKIFIED POLYETHYLENE LAYERS IN STRETCH/CLING FILMS

FIELD OF THE INVENTION

The present invention relates generally to thermoplastic films and, more particularly, to thermoplastic films having properties making them especially well suited for use as stretch/cling wraps in various bundling, packaging and palletizing operations.

BACKGROUND OF THE INVENTION

Stretch/cling films have found utility in a wide variety of fields including the bundling and packaging of food and other goods. One application of particular, but not limiting, interest to the present invention is in the bundling of goods for shipping and storage such as, for example, the bundling of large rolls of carpet, fabric or the like for shipping from the manufacturer to a retail outlet. An important subset of these bundling applications is in the containment and unitizing of pallet loads.

The load of a pallet may be unitized or "bundled" by stretch-wrapping a film several times around the articles to be palletized. There exist a variety of stretch-wrapping techniques, two of which are commonly employed. In one technique, the loaded pallet is placed on a rotating turntable and the end of a continuous roll of film attached to the load. As the turntable rotates, the film is continuously wrapped around the pallet and load. Tension is applied to the film roll to cause the film to stretch as it is applied.

Because the film is in a stretched condition, it is placed under considerable tension and will have a tendency to return to its original, unstretched state. This tension can cause the film to unravel from the wrapped pallet, thereby jeopardizing the integrity of the unitized load. It is desirable, therefore, that the film have cling properties to prevent unraveling of the film from the pallet.

To impart cling properties to, or improve the cling properties of, a particular film, a number of well-known tackifying additives have been utilized. Common tackifying additives include polybutenes, terpene resins, alkali metal and glycerol stearates and oleates and hydrogenated rosins and rosin esters. The cling properties of a film can also be modified by the well-known physical process referred to as corona discharge.

The use of tackifiers ordinarily is not desirable. While tackification is known in the art to enhance cling in an olefin cling film relative to an untackified film, this property improvement is not typically seen in the stretched film, and cling can become unsatisfactory when the film is stretched. Furthermore, the tackifier may present blending difficulties during film manufacture, adversely affect optical properties of the film and enhance surface migration of the additive. Such migration can damage the wrapped goods and has been known to cause the collapse and/or telescoping of rolls.

While "inner" surface cling in such film wraps is desirable, "outer" surface cling may be detrimental to the integrity of the load. Cling between adjacent wrapped pallets may cause tearing or puncturing of or other damage to the wrap as the pallets are transported. For this reason, it is desirable for the film to have slip or at least non-cling properties on its "outer" side to prevent this interpallet cling. Slip is defined in terms of coefficient of friction. In other words, it is desirable that the "outer" side of the film have a low coefficient of friction in contact with another object, particularly another like film. As with cling, slip can be imparted to the film or improved through the use of various well-known slip and/or antiblock additives including silicas, silicates, diatomaceous earths, talcs and various lubricants. Under highly stretched conditions, however, the coefficient of friction in the films tends to increase and even the slip additives may not provide the desired slip properties.

The tension in the stretched film may also cause the film to be more susceptible to punctures and tears. It is, therefore, also desirable for the film, as a whole, to have good stretch, tensile, puncture resistance and tear resistance properties.

Additionally, thermal stability of the various film components is important for the recycling of edge trim and film scrap generated in the various film production processes.

A wide variety of thermoplastic polymers such as, for example, polyvinyl chloride, polyethylene, polypropylene and various polymers of ethylene and other comonomers, most notably vinyl acetate, have been used as stretch/cling films. These materials standing alone, however, suffer from a number of shortcomings. Most cannot be stretched to a great extent without adversely affecting their slip, tensile, tear resistance and puncture resistance properties. For the particular case of ethylene-vinyl acetate polymers, thermal stability becomes a problem on the reprocessing of trim and scrap.

More recently, the use of multilayer films has gained popularity. With a multilayer film, one can obtain a stretch/cling wrap having cling properties on one side and slip properties on the other side. For example, U.S. Pat. No. 4,518,654 discloses a multilayer film having an A/B construction wherein the A side has cling characteristics and the B side has slip characteristics. In the aforementioned patent, the A side is said to comprise a polyethylene or an ethylene-monoolefin polymer, preferably linear low density polyethylene (LLDPE). To provide the LLDPE with the desired cling properties, a tackifying agent such as polyisobutylene (PIB), which migrates to the film surface or "blooms," is added to the polymer. The B side is said to comprise a low density polyethylene (LDPE) with an anticling additive added to impart the desired slip properties to the LDPE. This patent is hereby incorporated by reference herein for all purposes as if fully set forth.

Other multilayer films comprising layers of the various aforementioned stretch/cling materials are disclosed in U.S. Pat. Nos. 3,508,944, 3,748,962, 3,817,821, 4,022,646, 4,082,877, 4,147,827, 4,189,420, 4,194,039, 4,303,710, 4,399,180, 4,364,981, 4,418,114, 4,425,268, 4,436,788, 4,504,434, 4,588,650 and 4,671,987; U.K. Patent Application No. 2,123,747; French Patent No. 2,031,801; and European Patent Application No. 0,198,091, all of which are also incorporated by reference herein for all purposes. These multilayer films are generally produced by one of a number of well-known coextrusion processes also disclosed in the aforementioned incorporated references.

Many of the multilayer films, however, still suffer from shortcomings possessed by their individual layers. For instance, films containing a tackifying additive may be prepared and used in such a manner that the tackifier is "picked off" and onto the slip side of the film because the slip and cling layers of the film are in intimate contact on the film roll. Others do not possess desired slip properties, particularly when in a highly stretched state. Still others do not possess a desirable combination of stretch, tensile, tear resistance, puncture resistance, optical and thermal stability properties.

In European Patent Application No. 0,317,166 and U.S. Ser. No. 123,002, filed Nov. 19, 1987, both of which are hereby incorporated herein by reference, there is described a stretch/cling film having a cling layer of ethyleneacrylate copolymer. The film preferably avoids the use of a tackifier.

Hot melt adhesives, containing a blend of (a) high density polyethylene or isotactic polypropylene, (b) a copolymer of ethylene and an alkyl ester of acrylic or methacrylic acid or vinyl acetate, (c) an ionomer resin and (d) a tackifier such as a terpene resin or a glyceryl ester of a rosin acid, are described in U.S. Pat. Nos. 4,337,298 and 4,367,113 to Karim et al.

SUMMARY OF INVENTION

The present invention, therefore, provides a thermoplastic film having properties especially well suited for use as a stretch/cling wrap.

The present invention also provides a thermoplastic film having excellent cling properties, even in a highly stretched state.

The present invention further provides a multilayer stretch/cling film having excellent cling properties on one side and excellent slip properties on an opposite side, even in a highly stretched state.

Still further, the present invention provides a multilayer stretch/cling film which, as a whole, possesses desirable stretch, tensile strength, puncture resistance, tear resistance, optical and thermal stability properties.

Finally, the present invention provides a process for producing such a stretch/cling film, a process for using such stretch/cling film to bundle, package or unitize an article or a plurality of articles, and an article or plurality of articles so bundled, packaged or unitized.

In accordance with the present invention, there is provided a thermoplastic film which comprises, in its overall concept, a cling layer comprising a blend of polyethylene and a compatible tackifier. The polyethylene is preferably linear low density polyethylene (LLDPE), a copolymer of ethylene and an α-olefin having from 3 to about 12 carbon atoms, and preferably has a density ranging from about 0.87 to about 0.92 g/cc and a narrow molecular weight distribution. The LLDPE preferably has a density of from about 0.88 to about 0.905 g/cc. The tackifier is an aliphatic hydrocarbon tackifier and preferably comprises from about 1 to about 30 percent by weight of the cling layer, more preferably from about 5 to about 15 percent by weight of the cling layer. The blend has a glass transition temperature of about 0° C. or less.

The tackified LLDPE cling layer may be a monolayer for use as a two-sided cling film in stretch-wrap or other applications because it can have suitable structural characteristics, as well as cling. In an alternate embodiment, however, the thermoplastic film may further comprise a second cling layer opposite the first cling layer, but preferably comprises a non-cling layer opposite the cling layer, the non-cling layer comprising any suitable thermoplastic material such as, for example, polyethylene (including high density, low density and linear low density polyethylenes), polypropylene, etc. Particularly preferred is polypropylene. The non-cling side should, of course, be essentially free of the tackifier from the cling layer so that the non-cling layer retains its non-cling characteristics. Additionally, the non-cling side may include one or more well-known anticling (slip and/or antiblock) additives, but the non-cling layer is preferably essentially free of such anticling additives.

The thermoplastic film of the invention may be so constructed that a layer adjacent the first cling layer is a structural layer, and the second skin layer is positioned adjacent the structural layer. That is, the structural layer separates the first cling layer and the second layer. The second layer of the thermoplastic film may comprise a cling layer or a non-cling layer. In either case, the second layer may be a polyolefin. Preferably, when the second layer is a cling layer, it also comprises a blend of polyethylene and a compatible aliphatic tackifier. Where the third layer is a non-cling layer, it may include one or more of the well-known anticling (slip and/or antiblock) additives.

The structural layer of the thermoplastic films having more than 2 layers comprises about 5 to 95%, preferably at least about 50%, more preferably at least about 70–80% of the weight of the film. The structural layer may comprise a polyolefin of suitable makeup for the purpose to which the film is to be applied, such as, for example, linear low density polyethylene which is common for strength and optical properties in unitizing applications of stretch/cling films.

The thermoplastic film of the present invention may be produced utilizing any one of a number of well-known extrusion or coextrusion (in the case of multilayer films) equipment and processing conditions. In a multilayer film, the cling layer will preferably comprise from about 5% to about 95%, and the non-cling layer(s) will preferably comprise from about 95% to about 5%, of the total combined thickness of the film layers.

Thermoplastic films produced in accordance with the present invention have excellent cling properties on the cling layer and non-cling properties preferably slip properties, on the non-cling layer. The present thermoplastic films, as a whole, additionally have desirable stretch, tensile, puncture resistance and tear resistance properties. Further, the thermoplastic compounds used for the cling and non-cling layers have excellent thermal stability, and edge trim scrap can be processed without significant loss of film performance. This combination of properties makes the thermoplastic films of the present invention especially well suited for use as stretch/cling wraps.

These and other features and advantages of the present invention will be more readily understood by those skilled in the art from reading on the following detailed description.

BRIEF DESCRIPTION OF THE DRAWING

The FIGURE illustrates the effect of ESCOREZ 5320 tackifier concentration in an LLDPE cling layer of a coextruded LLDPE/PP one-sided stretch/cling film at 0% and 200% stretch in accordance with the present invention.

DETAILED DESCRIPTION OF THE INVENTION

Figure 1:
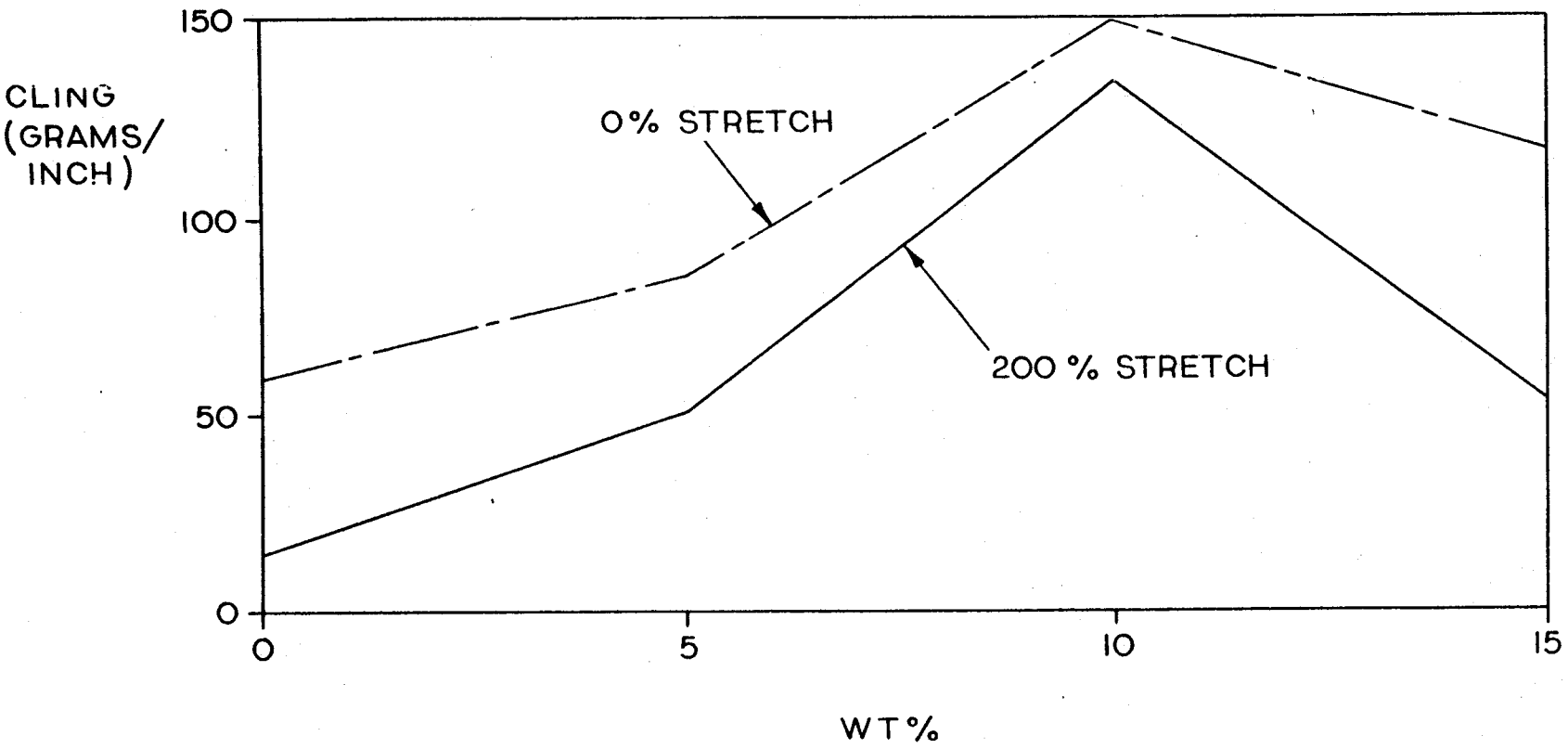

It has been discovered that stretch/cling films having a cling layer comprising a polyethylene blended with a compatible tackifier exhibit cling properties even in a highly stretched state. Furthermore, the present invention provides a thermoplastic film having excellent cling, slip, stretch, tensile, tear resistance, puncture resistance, optical and thermal stability properties, making such film especially well suited for use as a stretch/-cling wrap.

The thermoplastic film, in its overall concept, comprises a cling layer which preferably comprises LLDPE and a compatible tackifier. The LLDPE comprises ethylene copolymerized with a minor proportion of one or more α-olefin comonomers having from 3 to about 12 carbon atoms, preferably from 4 to 8 carbon atoms. Representative examples of such comonomers include butene-1, 1-pentene, 1-hexene, 4-methyl-pentene-1, 1-octene, 1-decene, and the like. Of these, butene-1 is particularly preferred. The α-olefin is typically present in an amount ranging from about 1 to about 20 percent by weight of the LLDPE.

In a preferred embodiment, the LLDPE has a density ranging from about 0.87 to about 0.92, and in a more preferred embodiment LLDPE with a density of from about 0.88 to about 0.905 g/cc is used. The LLDPE may have a wide range of melt indexes (MI), generally between about 0.1 to about 30, more preferably between about 1 to about 10 dg/min (ASTM D-1238, Condition E).

Weight average molecular weight ($M_w$) of the LLDPE may range from about 50,000 to about 1,000,000, preferably from about 100,000 to about 500,000, most preferably from about 150,000 to about 350,000. Molecular weight distribution is preferably narrow such that the ratio of $M_w$ to number average molecular weight ($M_n$) is less than 6, preferably less than 3 and more preferably about 2 or less. In addition, the LLDPE preferably has a low (less than about 1 percent) cold (0° C.) hexane solubles percentage.

Manufacture of such LLDPEs is well known in the art. Any of several process may be utilized including both high and low pressure processes, generally employing coordination type catalysts. A preferred LLDPE may be obtained from Mitsui under the trade designation TAFMER. TAFMER is an ethylene/butene-1 copolymer with a density of about 0.90 g/cc, a ratio of $M_w/M_n$ of about 2 and a cold hexane solubles of less than about 0.5 percent.

The tackifier comprises a compatible resin imparting cling to the LLDPE, preferably in a highly stretched state and without adversely affecting the optical properties or any other properties of the film. By the term "compatible," it is meant that the tackifier is miscible with the LLDPE on a molecular scale at conditions of fabrication and use. The tackifier should be selected and used in such a proportion so as to obtain a cling layer of suitable characteristics. If an insufficient or excessive proportion of the tackifier is used, the cling layer may not have sufficient cling for utility as a stretch/wrap film. Also, if too much tackifier is employed, the physical properties of the cling layer can be adversely affected. Generally, the upper limit on the quantity of tackifier which can be employed depends in large part on the glass transition temperature of the tackifier and its compatibility with the LLDPE. The glass transition temperature of the cling layer blend should preferably not exceed about 0° C., and is more preferably in the range of from about −20° C. to about 0° C. to avoid excessive brittleness. Thus, the tackifier preferably has a glass transition temperature of between about −50° C. to about 50° C., and more preferably above about −10° C. The proportion of tackifier used desirably should not exceed the upper compatibility limit, if any, or result in a glass transition temperature of the blend which is too high so that the cling layer is undesirably brittle. The tackifier preferably comprises from about 1% to about 30%, more preferably from about 5% to about 15%, by weight of the cling layer.

LLDPE-compatible tackifiers include aliphatic hydrocarbon resins, i.e. resins wherein less than 50 percent of the hydrogen therein is aromatic, preferably less than about 10 percent and more preferably less than about 1 percent, as determined by NMR spectrometry. Where optical properties of the film are important, the tackifier should have good clarity, preferably a color index of about 2 or less on the Gardner scale. Aliphatic hydrocarbon resins are available under the trade designations ESCOREZ, PICCOTAC, ARCON, and the like. Exemplary tackifiers include ECR-111, ECR-143H and ESCOREZ-5320, hydrogenated cycloaliphatic hydrocarbons having a ring and ball softening point of from about 40° C. to about 60° C., commercially available from Exxon Chemical.

Hydrocarbon tackifiers are generally manufactured from $C_5$ aliphatic monomers or a mixture thereof. These monomers are derived from the so-called $C_5$ cuts in the fractionation of crude oil, or similar material. ECR-143H, for example, is prepared by the cationic polymerization of a $C_5$ olefin/diolefin feed stream as described in U.S. Pat. No. 4,916,192 which is incorporated herein by reference.

The tackifier may be added to the LLDPE during or after the polymerization reaction, or otherwise mixed in any manner obtaining an intimate blend therewith, to impart the cling properties to the film.

The cling layer may, if desired, also include one or more other well-known additives such as, for example, antioxidants, ultraviolet absorbers, antistatic agents, release agents, pigments, colorants or the like; however, this should not be considered a limitation of the present invention. The cling layer blend should be essentially free of incompatible additives and other ingredients in such quantities as would substantially impair the cling or other advantageous properties of the blend.

The film of the present invention may further comprise a second cling layer opposite this first cling layer, but preferably further comprises a non-cling layer opposite the cling layer, with the non-cling layer comprising any suitable polyolefin or combination of polyolefins such as polyethylene, polypropylene, copolymers of ethylene and propylene, and polymers obtained from ethylene and/or propylene copolymerized with minor amounts of other olefins, particularly $C_3$–$C_{12}$ olefins. Linear low density polyethylene (LLDPE), i.e., a copolymer of ethylene with up to about 20% by weight $C_3$–$C_{12}$ olefin(s), is a suitable non-cling layer polymer, and preferred olefins therein include 1-butene, 1-hexene, 1-octene and 4-methylpentene-1.

Polypropylene is a particularly preferred non-cling layer polymer. Even though the tackifier used in the cling layer is generally non-migratory because of its compatibility with the LLDPE, if the tackifier should somehow contaminate the polypropylene slip layer, the polypropylene will still not become clingy. This is because the polypropylene has a glass transition temperature which is too high to allow the polypropylene to become tacky, in contrast to polyethylenes used in a non-cling layer. Employing polypropylene in the slip layer has the additional advantage of imparting abrasion resistance thereto.

Suitable polypropylene is normally solid and isotactic, i.e., greater than 90% hot heptane insolubles, having wide ranging melt flow rates of from about 0.1 to about 300 dg/min. As is known, such polypropylene is normally crystalline with a density range of from about 0.89 to about 0.91 g/cc. Such polypropylene and methods for making the same are well-known in the art and are readily available commercially.

Additionally, the non-cling layer may include one or more anticling (slip and/or antiblock) additives which may be added during the production of the polyolefin or subsequently blended in to improve the slip properties of this layer. Such additives are well-known in the art and include, for example, silicas, silicates, diatomaceous earths, talcs and various lubricants. These additives are preferably utilized in amounts ranging from about 100 ppm to about 20,000 ppm, more preferably between about 500 ppm to about 10,000 ppm by weight based upon the weight of the slip layer.

The non-cling layer may, if desired, also include one or more other well-known additives such as, for example, antioxidants, ultraviolet absorbers, antistatic agents, release agents, pigments, colorants or the like; however, this again should not be considered a limitation of the present invention.

Additionally, normal trim and scrap from the film production process can be recycled into either the cling or non-cling layers, but preferentially to the non-cling layer of a two-layer film or the core structural layer of a three-layer film.

The present invention may also include one or more intermediate layers between the cling and non-cling layers for any one of a number of well-known purposes such as, for example, to modify the overall physical properties balance of the film, to utilize the recycle trim and scrap or to provide a barrier layer to oxygen or other gases. As just indicated, this intermediate layer may comprise the recycle trim and scrap, or may comprise any other suitable polymer. The intermediate layer(s), however, is optional and should not be considered a limitation on the present invention.

In preparing the thermoplastic stretch/cling films of the present invention, any one of a number of well-known extrusion or coextrusion (in the case of multilayer films) techniques as disclosed in the previously incorporated references may be utilized. As preferred examples, any of the blown or chill roll cast processes as disclosed and described in those references is suitable for use in producing thermoplastic stretch/cling films in accordance with the present invention.

In a multilayer film, the cling layer preferably comprises between about 5% to about 95%, more preferably between about 5% to about 35%, most preferably between about to about 15% of the combined thickness of the film layers. Conversely, the non-cling layer(s) (including any structural or other intermediate layer) preferably comprises between about 1% to about 95%, more preferably between about 65% to about 95%, most preferably between about 85% to about 95% of the combined thickness of the film layers.

As previously mentioned, the thermoplastic films of the present invention have properties making them especially well suited for use as stretch/cling films, however this use should not be considered a limitation on the present invention. For example, these films can be made into other forms, such as a tape, by any one of a number of well-known cutting, slitting and/or rewinding operations. Physical properties including, but not limited to, tensile strength, tear strength and elongation can be adjusted over wide ranges by altering the resin types and specifications as appropriate to meet the requirements to a given wrapping, bundling or taping application.

For bundling, packaging and unitizing applications, the thermoplastic film of the present invention is stretch-wrapped by any one of a number of well-known procedures (such as those disclosed in the aforementioned incorporated references) around an article or a plurality of articles preferably so that the cling layer faces inside (towards the article) and the non-cling layer faces outside (away from the article), although this film orientation should not be considered as a limitation on the invention. Typical of articles suitable for bundling, packaging and unitizing with the present thermoplastic film include, but are not limited to, various foodstuffs (canned or fresh), rolls of carpet, liquid containers and various like goods normally containerized and/or palletized for shipping, storage and/or display.

The films of the invention may also be used in surface protection applications with or without stretching. Especially at about 10 percent by weight tackifier concentration in the LLDPE polymer, the films are very effective in the temporary protection of surface during manufacturing, transportation, etc. The easily coextruded films of the invention are also often less expensive than known surface protection films of, e.g., LLDPE and acrylic layers. Advantageously, the films of the invention do not leave adhesive traces on the surface to be protected and have good UV stability.

The foregoing more general discussion of this invention will be further exemplified by the following specific examples offered by way of illustration and not limitation of the above-described invention.

In the following examples, property evaluations were made in accordance with the following test:

Cling—cling is reported as the force in grams required to partially peel apart two strips of film. A first film strip is attached to a 30° inclined plane with the outside surface (slip) facing upward. A second 1"×8" strip is placed on top of the first strip with the inside surface (cling) facing downward. Pressure is applied to the second strip to cause the two strips to stick together. If an evaluation of cling under stretched conditions is desired, both film strips are prestretched and allowed to relax before testing. The end of the second strip at the base of the inclined plane is attached, by clip and string, to an apparatus which can exert a strain at a constant rate (Instron 1130). The two strips are then pulled apart at a crosshead speed of 10 cm/min until the aforementioned string is parallel with the base of the inclined plane. The force at this point is reported as cling.

EXAMPLES

A TAFMER LLDPE ethylene/butene-1 copolymer made by Mitsui (MI 3 dg/min; density 0.90 g/cc; $M_w/M_n \cong 2$) was coextruded with a PP-3014 polypropylene (PP) made by Exxon Chemical Company (MFR 12 dg/min). Slip (Kememide E, a commercial erucamide available from Humko Chemical Company, Memphis, Tenn.) and antiblock (AB) (Super Floss TM a commercial silica available from Johns Manville) were added to the PP. Four different coextruded structures were prepared having 0, 5, 10 and 15 percent by weight ESCOREZ 5320 tackifier in the LLDPE cling layer.

The film was produced by coextruding the LLDPE copolymer and PP on a Killion cast film line with two ¾" extruders, respectively, for the LLDPE and PP layers. The LLDPE was extruded at a melt temperature of 445° F., while the PP was extruded at a melt temperature of 480° F. The chill roll temperature was set to 76 and the line speed to 41 feet per minute.

The resulting film had a gauge of 0.8 mil with the LLDPE layer comprising 20% of the total film thickness. The inside layer to outside layer (I/O) cling (LLDPE/PP) was measured for 0% and 200% stretch at varying concentrations of tackifier in the cling layer. The results are presented in the FIGURE.

The results presented in the FIGURE show that films in accordance with the present invention exhibited good cling in highly stretched conditions, especially with a tackifier concentration of about 10 percent by weight. It is thought that the cling performance of the coextruded film illustrated in the FIGURE fell off at greater than 10% by weight tackifier concentration because the glass transition temperature ($T_g$) of the LLDPE cling layer was raised too high by the tackifier.

Many modifications and variations besides the embodiments specifically mentioned may be made in the compositions and methods described herein without substantially departing from the concept of the present invention. Accordingly, it should be clearly understood that the form of the invention described herein is exemplary only, and is not intended as a limitation of the scope thereof.

What is claimed is:

1. A stretch/wrap thermoplastic film, comprising:

a cling layer comprising a blend of (i) polyethylene having a density of from about 0.87 to about 0.92 g/cc, a melt index of from about 0.1 to about 30 dg/min, and a ratio of weight average molecular weight to number average molecular weight ($M_w/M_n$) less than about 6, and (ii) a compatible hydrogenated cycloaliphatic hydrocarbon tackifier, said blend having a glass transition temperature of about −20° C. to about 0° C., said tackifier having a Tg of between about −50° C. to about 50° C.

2. The film of claim 1, wherein said polyethylene comprises a copolymer of ethylene and an α-olefin having from 3 to about 12 carbon atoms.

3. The film of claim 1, further comprising a second layer adjacent said cling layer.

4. The film of claim 2, wherein said film is a monolayer of said blend.

5. The film of claim 2, wherein said copolymer has a density in a range of from about 0.89 to about 0.905 g/cc.

6. The film of claim 2, wherein said ratio $M_w/M_n$ is less than about 3.

7. The film of claim 1, wherein said tackifier comprises from about 1 to about 30 percent by weight of said cling layer.

8. The film of claim 1, wherein less than about 10 percent of hydrogen in said tackifier is aromatic.

9. The film of claim 3, wherein said second layer is a polyolefin.

10. The film of claim 9, wherein said second layer polyolefin is essentially free of said tackifier.

11. The film of claim 10, wherein said polyolefin layer is a slip layer of polypropylene.

12. The film of claim 9, wherein said polyolefin layer comprises an intermediate structural layer and, opposite said cling layer, another cling layer of said blend of said polyethylene and said tackifier.

13. The film of claim 9, wherein said adjacent polyolefin layer comprises an intermediate structural layer and, opposite said cling layer, a non-cling layer of polyethylene or polypropylene.

14. The film of claim 13, wherein said non-cling layer is a slip layer comprising polypropylene having greater than 90% hot heptane insolubles and a melt flow rate of from about 0.1 to about 300 dg/min.

15. The film of claim 9, wherein said second layer comprises linear low density polyethylene having a density from about 0.88 to about 0.92 g/cc and a melt index between about 0.5 to about 10 dg/min.

16. A stretch/wrap thermoplastic film, comprising:

a cling layer comprising a blend of linear low density polyethylene and from about 1 to about 30 weight percent of a compatible tackifier, said blend having a glass transition temperature less than about 0° C.;

said polyethylene having a density of from about 0.89 to about 0.905 g/cc, a melt index of from about 0.1 to about 30 dg/min, a ratio of weight average molecular weight to number average molecular weight ($M_w/M_n$) less than about 3 and less than about 1 percent cold hexane solubles;

said tackifier having a glass transition temperature of between about −50° C. to about 50° C. wherein less than about 10 percent of hydrogen in said tackifier is aromatic; and a polypropylene slip layer opposite said cling layer essentially free of said tackifier.

17. The film of claim 16, wherein said tackifier comprises from about 5 to about 15 percent by weight of said cling layer.

18. The film of claim 17, wherein less than about 1 percent of hydrogen in said tackifier is aromatic.

19. The film of claim 17, wherein said polypropylene has greater than 90% hot heptane insolubles and a melt flow rate of from about 0.1 to about 300 dg/min.

20. A process for producing a thermoplastic film having a cling layer opposite a second layer, comprising the steps of:

blending a linear low density polyethylene with a compatible aliphatic hydrocarbon tackifier to obtain a blend having a glass transition temperature of about 0° C. or less, said polyethylene comprising a copolymer of ethylene and an α-olefin having from 3 to about 12 carbon atoms and having a density of from about 0.87 to about 0.92 g/cc, a melt index of from about 0.1 to about 30 dg/min, and a ratio of weight average molecular weight to number average molecular weight ($M_w/M_n$) less than about 6; and coextruding said blend with polypropylene to form a stretch/wrap film having a cling layer comprising said blend and a slip layer of said polypropylene.

21. A method for bundling, packaging or unitizing an article or a plurality of articles, comprising:

stretch-wrapping the thermoplastic film of claim 1 around the article or articles.

22. A bundled, packaged or unitized article or plurality of articles, comprising:

the article or plurality of articles having the thermoplastic film of claim 1 stretch-wrapped around said article or plurality of articles.

23. A method for the surface protection of an article, comprising:

covering the surface to be protected on the article with the thermoplastic film of claim 1.

* * * * *